United States Patent [19]

Kimura et al.

[11] Patent Number: 4,661,237

[45] Date of Patent: Apr. 28, 1987

[54] PROCESS FOR THERMAL CRACKING OF CARBONACEOUS SUBSTANCES WHICH INCREASES GASOLINE FRACTION AND LIGHT OIL CONVERSIONS

[75] Inventors: Muneaki Kimura, Shuzuoka; Tadashi Kai, Tokyo, both of Japan

[73] Assignee: Asahi Kasei Kogyo Kabushiki Kaisha, Osaka, Japan

[21] Appl. No.: 480,177

[22] Filed: Mar. 29, 1983

[30] Foreign Application Priority Data

Mar. 29, 1982 [JP] Japan ..... 57-50406
Jul. 28, 1982 [JP] Japan ..... 57-130494

[51] Int. Cl.[4] ..... C01G 1/06
[52] U.S. Cl. ..... 208/423; 208/413
[58] Field of Search ..... 208/10, 8 R, 11 R, 112, 208/59, 61; 201/2.5

[56] References Cited

U.S. PATENT DOCUMENTS

| | | | |
|---|---|---|---|
| 3,030,297 | 4/1962 | Schroeder | 208/8 |
| 3,152,063 | 10/1964 | Schroeder | 208/10 |
| 3,549,512 | 12/1970 | Hodgson | 208/10 |
| 3,594,305 | 7/1971 | Kirk, Jr. | 208/10 |
| 3,617,486 | 11/1971 | Lewis et al. | 208/59 |
| 3,660,270 | 5/1972 | Mason | 208/59 |
| 3,682,813 | 8/1972 | Din et al. | 208/59 |
| 3,700,584 | 10/1972 | Johanson et al. | 208/10 |
| 3,823,084 | 7/1974 | Schroeder | 208/10 |
| 3,926,775 | 12/1975 | Schroeder | 208/10 |
| 3,960,700 | 6/1976 | Rosen et al. | 208/8 R |
| 4,048,053 | 9/1977 | Green | 208/8 |
| 4,169,128 | 9/1979 | Senoi et al. | 208/8 R X |
| 4,225,414 | 9/1980 | Duncan | 208/8 R |
| 4,451,354 | 5/1984 | Stuntz | 208/59 X |
| 4,473,460 | 9/1984 | Kuerten et al. | 208/10 |

FOREIGN PATENT DOCUMENTS 51-111205 10/1976 Japan ..... 208/10

OTHER PUBLICATIONS

Journal of Catalysis, 27, 293-300 (1972), Tomita et al, "Hydrogenation of Carbons Catalyzed by Transition Metals".

Carbon, 15, 103-106 (1977), Tamai et al, "Catalytic Gasification of Carbon with Stream, Carbon Dioxide and Hydrogen".

Carbon, 12, 453-464 (1974), McKee, "Effect of Metallic Impurities on the Gasification of Graphite in Water Vapor and Hydrogen".

Nenryo Kyokai-shi, 58, No. 625, 386 (1979), Kasaoka et al, "Effects of Catalysis and Composition of Inlet Gas on Gasification of Carbon and Coal".

*Primary Examiner*—John Doll
*Assistant Examiner*—William G. Wright
*Attorney, Agent, or Firm*—Sughrue, Mion, Zinn, Macpeak & Seas

[57] ABSTRACT

A process for thermally cracking carbonaceous substances, such as coal, is described, comprising: rapidly heating the carbonaceous substance to 500° to 950° C. in an atmosphere consisting essentially of hydrogen gas at a pressure of 35 to 250 kg/cm$^2$ (gauge pressure) in the presence of at least one compound selected from the group consisting of halides, sulfates, nitrates, phosphates, carbonates, hydroxides, and oxides of Group VIII metal elements of the Periodic Table. The process increases the cracking of the carbonaceous substances and accelerates the conversion of the carbonaceous substances into gas and liquid products, greatly increasing the yields of the gasoline fraction and light oils.

21 Claims, 2 Drawing Figures

PROCESS FOR THERMAL CRACKING OF CARBONACEOUS SUBSTANCES WHICH INCREASES GASOLINE FRACTION AND LIGHT OIL CONVERSIONS

FIELD OF THE INVENTION

The present invention relates to a process for thermally cracking carbonaceous substances in the presence of hydrogen to produce gases and liquid oils directly from the carbonaceous substances. More particularly, the present invention relates to a novel thermal cracking process which increases the cracking of carbonaceous substances, accelerates the conversion of the carbonaceous substances into gas and liquid products, and increases the yields of gasoline and light oil fractions.

BACKGROUND OF THE INVENTION

Recently, in view of the exhaustion of oil resources in the future, the usefulness primitive carbonaceous substances, such as coal and tar sand, which are now the most abundant fossil fuel sources and widely distributed all over the world have been reconsidered. These substances have received increasing attention as an energy source and a chemical feed capable of replacing petroleum. However, coal is a very complicated polymeric compound, and contains fairly large amounts of hetero atoms, such as oxygen, nitrogen, and sulfur, and ash, as well as carbon and hydrogen which are the major constitutive elements. Therefore, coal, when burned as such, produces large amounts of air pollution substances. Furthermore, coal is not desirable because its calorific value is low as compared with petroleum, and the transportation and storage of coal is cumbersome and expensive.

In order to overcome the above-described substantial problems of coal, a number of methods of liquifying coal have been proposed in which the coal is liquified to remove the hetero atoms and ash, and to produce fuel oils or gases causing no air pollution as well as chemical starting materials of high practical value. Typical examples include a method in which coal is extracted with a solvent (see U.S. Pat. No. 4,022,680), a method in which coal is liquified in the presence of hydrogen or a hydrogen-donating compound (see U.S. Pat. No. 4,191,629 and W. German Pat. No. 2,756,976), a method in which coal is liquified and gassified in the presence of hydrogen (see U.S. Pat Nos. 3,152,063, 3,823,084, 3,960,700, 4,169,128, 3,985,519 and 3,923,635), and a method in which coal is liquified and gassified in an inert gas (see U.S. Pat. No. 3,736,233).

In accordance with these methods, however, it is not possible to mainly and efficiently produce a gasoline fraction which is to be used as a fuel for transportation and a chemical feedstock, although the methods can directly produce those ingredients which can be used as an energy source.

A method of directly producing a gasoline fraction which has been known involves injecting finely ground coal in a high temperature and pressure hydrogen stream to achieve high-speed hydrogenation and thermal cracking of the coal in a short period of time of from several ten milliseconds to several minutes. More specifically the finely ground coal is injected into a hydrogen stream having a pressure of from 50 to 250 $kg/cm^2$ (gauge pressure) and a temperature of from 600° to 1,200° C. The coal is heated rapidly at a rate of from $10^2$ to $10^3$ ° C./sec to achieve the hydrogenation and thermal cracking. This method produces gas products such as methane, ethane, carbon monooxide, carbon dioxide, steam, hydrogen sulfide and ammonia, liquid products such as a gasoline fraction and heavy oil (comprising aromatic compounds containing at least 10 carbon atoms and high boiling tar), and a solid product containing ash, which is called "char".

This method, however, has various disadvantages. For example, when the reaction temperature is lowered, the total conversion of coal into liquid or gas is decreased, the total conversion being given by the following formula:

$$\text{Total Conversion} = \frac{\text{Number of carbon atoms in all products}}{\text{Number of carbon atoms in coal feed}} \times 100$$

Furthermore, heavy oils such as aromatic compounds containing at least 10 carbon atoms and tar are produced as main products. On the other hand, when the reaction temperature is raised, although the total conversion is increased, decomposition of liquid products is accelerated, resulting in the production of methane as a main product. This leads to a reduction in the gasoline fraction conversion; i.e., the conversion is at most from 3 to 8%.

As a result of extensive studies on the production of the gasoline fraction to be used as a fuel for transportation or a chemical feedstock from carbonaceous substances, such as coal, in high yield, it has been found that:

(1) the gasoline fraction is produced not only directly from the carbonaceous substances, but also from liquid products, intermediate products produced in the course of thermal cracking, which are further hydrocracked and converted into lighter products;

(2) the proportion of the gasoline fraction produced from the liquid products in the total gasoline fraction is much greater than that of the gasoline fraction produced directly from the carbonaceous substances;

(3) therefore, in order to increase the conversion of the carbonaceous substances into the gasoline fraction, it is necessary to increase the amount of the liquid products, i.e., gasoline fraction precursors, being formed; and (4) when the carbonaceous substances are thermally cracked in the presence of certain kinds of metal compounds, the thermal cracking is accelerated, and the conversion of the carbonaceous substances into the liquid products is increased.

Furthermore, it has been found that not only the conversion of the carbonaceous substances into the gasoline fraction is increased, but also the conversion of the carbonaceous substances into light oils is greatly increased. The term "light oil" as used herein refers to an oil composed mainly of from 2 to 5 ring-condensed aromatic compounds.

SUMMARY OF THE INVENTION

An object of the invention is to provide a novel thermal cracking process which increases decomposition of carbonaceous substances and accelerates the conversion of the carbonaceous substances into liquid products and gases, making it possible to produce a gasoline fraction directly from the carbonaceous substances in high yield.

The present invention relates to:

(1) a process for thermally cracking a carbonaceous substance which comprises heating the carbonaceous substance rapidly to a temperature of from 500° to 950° C. in an atmosphere essentially consisting of hydrogen gas of pressure of from 35 to 250 kg/cm$^2$ (gauge pressure) in the presence of at least one compound selected from the group consisting of halides, sulfates, nitrates, phosphates, carbonates, hydroxides and oxides of Group VIII metal elements of the Periodic Table; and (2) a process for thermally cracking a carbonaceous substance which comprises heating the carbonaceous substance rapidly to a temperature of from 500° to 900° C. in atmosphere consisting essentially of hydrogen gas of pressure of from 35 to 250 kg/cm$^2$ (gauge pressure) in the presence of at least one compound selected from the group consisting of halides, sulfates, nitrates, phosphates, carbonates, hydroxides and oxides of Group VIII metal elements of the Periodic Table, and then, cracking the above-thermally cracked carbonaceous substance at a temperature higher than the above temperature, but falling within the range of from 600° to 950° C.

DETAILED DESCRIPTION OF THE INVENTION

Figure 2:
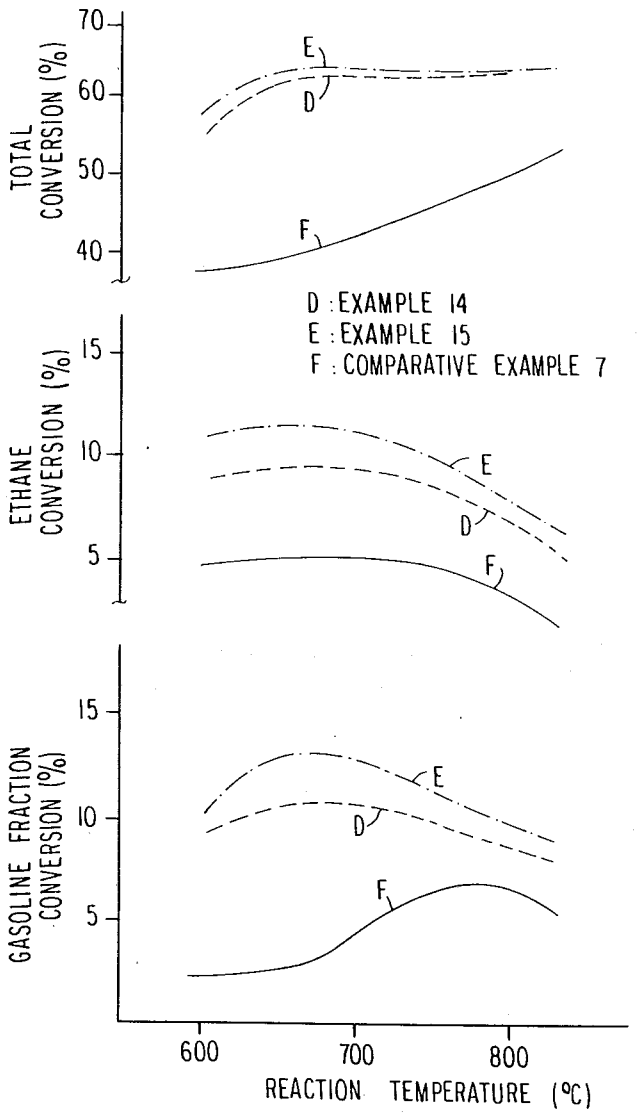
FIG. 2 shows graphs illustrating the relations between reaction temperature and total conversion, between reaction temperature and ethane conversion, and between reaction temperature and gasoline fraction conversion in Examples 14 and 15, and Comparative Example 7.

The Group VIII metal elements of the Periodic Table as used herein include Fe, Co, Ni, Ru, Rh, Pd and Pt. Of these metal elements, Fe, Co and Ni are preferred, because the compounds of Fe, Co and Ni such as iron sulfate, nickel sulfate, iron hydroxide and nickel hydroxide increase the rapid thermal cracking rate of the carbonaceous substance. This causes an increase in the conversion of the carbonaceous substance into a gasoline fraction and light oil. Further, the Fe, Co and Ni compounds are readily available, and therefore, are advantageous for use in the industrial practice of the process of the invention.

Any of the compounds of the Group VIII metal elements of the Periodic Table can be used to attain the objects of the invention. These compounds increase the total conversion of the carbonaceous substance by thermal cracking, increase the conversion of the carbonaceous substance into the gasoline fraction and light oil, and at the same time, decrease the cracking temperature. The type of the metal compounds used can be determined appropriately depending on the type of carbonaceous substance to be thermally cracked. Of these compounds, the halides, sulfates, nitrates, phosphates, carbonates and hydroxides are preferably used in the process of the invention. They are preferred because they increase the conversion of the carbonaceous substance into the gasoline fraction and light oil. For example, iron sulfate, nickel sulfate and nickel hydroxide are preferably used for the thermal cracking of brown coal, and iron hydroxide, iron nitrate and cobalt carbonate in addition to the above compounds are preferably used for the thermal cracking of bituminous coal and sub-bituminous coal. In particular, the sulfates, nitrates, carbonates and hydroxides are more advantageous since they increase the conversion of the carbonaceous substance into the gasoline fraction, and cause less corrosion of reaction equipment. When using those compounds the requirement generally requires no treatment to prevent corrosion.

Any compounds which are usually called carbonates can be used as the carbonates of the invention including basic carbonates.

In the process of the invention, the above-described metal compounds can be used alone or in combination with each other. In order to efficiently increase the conversion of the carbonaceous substance into the gas and liquid products, it is preferred that the metal compound is previously mixed with the carbonaceous substance. The resulting mixture is then introduced into a reactor, even though the metal compound and the carbonaceous substance can be fed separately to the reactor. The metal compound and the carbonaceous substance can be mixed by any suitable technique. For example, they are finely ground, and mechanically mixed by the use of, e.g., a mortor, a ball mill, a V-shaped powder mixer and a stirring mixer, or the metal compound is first dissolved or suspended in water or an organic solvent such as alcohol and the coal is then added to the resulting solution or suspension and dipped therein and finally the solvent is removed.

In mixing the hydroxide or carbonate with the carbonaceous substance, there can be used a process in which the halide, sulfate, nitrate or the like of the same metal element is dissolved in water or an organic solvent such as alcohol, followed by adding alkali hydroxide such as potassium hydroxide and sodium hydroxide, ammonia water or alkali carbonate to the resulting solution with stirring to form the corresponding hydroxide or carbonate. Coal is then added to the solution to deposit thereon the hydroxide or carbonate, and the coal with the hydroxide or carbonate deposited thereon is filtered off. Of course, the coal may be added to a solvent together with, for example, the halide, sulfate, or nitrate, and then, mixed with alkali hydroxide, ammonia water, or alkali carbonate, filtered, and washed.

This mixing process utilizing solvents is preferred in that the carbonaceous substance/metal compound mixture prepared using the solvents is superior in the dispersion and attaching properties of the metal compound onto the carbonaceous substance to the mechanically prepared mixture, and shows very high activity.

The amount of the metal compound added can be determined appropriately and optionally depending on the type of the carbonaceous substance used. For instance, the thermal crackings of bituminous coal and sub-bituminous coal are preferably performed with a larger amount of the metal compound (1.2 to 2 times larger) than that in the case of brown coal, and the thermal cracking of brown coal can be effectively performed even with a smaller amount of the Ni or Co compounds (e.g., 3/10 to 8/10 times smaller) than that of the Fe compounds. In general, the metal compound is added in an amount ranging from 0.0001 to 0.2 part by weight, preferably from 0.001 to 0.1 part by weight, more preferably from 0.005 to 0.1 part by weight, per part by weight of the carbonaceous substance (not containing water and ash). In lesser amounts than 0.0001 part by weight, the total conversion and the conversion of the carbonaceous substance into the gasoline fraction and light oil are low. On the other hand, in greater amounts than 0.2 part by weight, any further increase in the conversion is not obtained. Further, there is consumption of hydrogen due to the decomposition of the metal compound and the production of gases, liquid products and char, containing large amounts of S, N, P and halogen. This is undersirable and causes problems such as air pollution and corrosion of the reactor. In the thermal cracking of brown coal, the Ni compounds and the Fe compounds are preferably added in amounts of 0.005 to 0.05 part by weight and 0.01 to 0.1 part by weight, respectively, per part by weight of the carbonaceous substance.

When the metal compounds are used as a mixture comprising two or more thereof, it is preferred that at least one of the compounds of Fe, Co and Ni are present within the range of from 0.0001 to 0.1 part by weight, particularly preferably from 0.001 to 0.1 part, per part by weight of the carbonaceous substance.

The cracking temperature as used in the process of the invention is within the range of from 500° to 950° C. This temperature is higher than the temperatures at which the usual liquification processes utilizing solvents are performed, but lower than the temperatures as used in the usual gasification processes. The use of the metal compounds as described above makes it possible to obtain the maximum yield of the gasoline fraction within a temperature range about 20° to 200° C. lower than the thermal cracking temperature that is needed for the thermal cracking of the carbonaceous substance in the absence of the metal compounds.

The thermal cracking temperature can be chosen appropriately within the above-described range depending on, for example, the characteristics such as type, viscosity and grain size, of the carbonaceous substance, heating time and the type of the metal compound used. For example, when the heating time is 7 seconds, the temperature is preferably from 600° to 800° C. for the thermal cracking of carbonaceous substances having a low degree of carbonation and from 700° to 850° C. for those having a high degree of carbonation. The term "high degree of carbonation" used herein means high carbon content, in other words low ratio of hydrogen content to carbon content. Further the thermal cracking can be performed within a relatively low temperature range using hydroxides or carbonates of the present invention. When the temperature is lower than 500° C., the cracking is reduced, and the total conversion and the conversion of the carbonaceous substance into the gasoline fraction and light oil are decreased. On the other hand, when the temperature exceeds 950° C., the cracking rates of the gasoline fraction and light oil seriously increase. This undesirably leads to a reduction in the yield of the gasoline fraction and an increased formation of gas comprised mainly of methane.

The heating time is not critical and varies depending upon the types of the carbonaceous substance and the metal compound and the thermal cracking temperature. The time is usually from 0.02 to 60 seconds and preferably from 2 to 30 seconds. When it is too short, the liquid products are not converted into the gasoline fraction and light oils, and when it is too long, the formation of methane becomes remarkable. In particular, the gasoline fraction can be effectively produced for 2 to 15 seconds in the thermal cracking of brown coal or subbituminous coal at 650° to 800° C. using the Fe compounds.

It has further been found that the gasoline fraction can be produced in much larger amounts by rapidly heating the carbonaceous substance at a temperature of from 500° to 900° C. in the presence of the above-described metal compound to crack the carbonaceous substance and diffuse the volatile components from the solid matrix, and subsequently, by cracking the above-thermally cracked carbonaceous substance at a temperature higher than the above-described cracking temperature, but falling within the range of from 600° to 950° C. In the first step, relatively low molecular weight products can be effectively produced while minimizing the formation of char and gas, and the resulting low molecular weight products can be efficiently converted into the gasoline fraction in the second step.

The optimum combination of the first cracking temperature (the cracking temperature of the carbonaceous substance at the first step) and the second cracking temperature (the cracking temperature of the carbonaceous substance at the second step) is determined appropriately depending on the type of the carbonaceous substance. In general, the difference between the first and second cracking temperatures is from 10° to 150° C. For coal having a low degree of carbonation such as brown coal and lignite, the first cracking temperature may be relatively low, and thus, the temperature difference tends to increase.

The reaction time at the second cracking step is preferably from 1 to 60 seconds, more preferably from 2 to 30 seconds. When the reaction time is shorter than 1 second, the conversion of the carbonaceous substance into the gasoline fraction proceeds only insufficiently, whereas when it is longer than 60 seconds, the possibility of decomposition of the gasoline fraction increases. For coal having a low degree of carbonation, the second cracking time is preferably short (2 to 15 seconds), whereas it is preferably long (5 to 30 seconds) for coal having a high degree of carbonation.

The rate of heating of the carbonaceous substance in the process of the invention is preferably at least 100° C./sec and more preferably at least 1,000° C./sec so that the gasoline fraction and its precursor, liquid product, are efficiently produced. When the heating rate is increased, the cleavage of cross-linking bonds in the structure of the carbonaceous substance, which results in the formation of the gasoline fraction and its precursor, liquid product, occurs more preferentially. Therefore there is no upper limitation with respect to the heating rate. For the purpose of the present invention, however, it is particularly preferably within the range of 1,000° to 10,000° C./sec.

The pressure of the atmosphere consisting essentially of hydrogen gas as used herein should be within the range of from 35 to 250 kg/cm$^2$ (gauge pressure), and preferably it is from 50 to 200 kg/cm$^2$. The term "atmosphere consisting essentially of hydrogen gas" as used herein includes both an atmosphere consisting of pure hydrogen gas alone and an atmosphere composed mainly of hydrogen gas. For example, the atmosphere may contain up to about 30% by volume of inert gas, steam, carbon dioxide, carbon monoxide, methane, etc. While the use of pure hydrogen gas results in increase of the gasoline fraction and light oils, the mixed gas may be used with the advantage that the thermal cracking process is simplified since steps for separating and purifying hydrogen gas can be omitted.

The pressure of the atmosphere consisting essentially of hydrogen gas is a particularly important condition in the practice of the process of the invention in view of its effect of preventing polycondensation of the active liquid compounds formed during the direct thermal cracking of the carbonaceous substance, and for the purpose of cracking the liquid compounds into the gasoline fraction. At the above-described second cracking step, higher pressures are more effective. However, even if the pressure is increased beyond a certain upper limit, no additional effect is obtained, and rather, increasing to such high pressures is economically disadvantageous because it increases the equipment cost.

In the process of the invention, the weight ratio of hydrogen to the carbonaceous substance feed (anhydrous and ash-free basis) varies with the type of the carbonaceous substance and the desired composition of reaction products. In general, the weight ratio of hydrogen to the carbonaceous substance feed (anhydrous and ash-free basis) is sufficient to be from 0.03/1 to 0.08/1. However, in order to accelerate the diffusion of liquid products from the carbonaceous substance and the diffusion of hydrogen into fine voids of the carbonaceous substance powder, to increase the conversion of the carbonaceous substance into the gasoline fraction and to prevent coking, it is preferred to feed the hydrogen excessively. An excess of hydrogen is separated from the reaction products from the carbonaceous substance, and returned to the reactor for re-use. For this reason, if the amount of hydrogen being fed is extremely increased, a greater amount of energy is needed for the separation/recycle process and heating. Furthermore, it is inevitably necessary to increase the size of equipment. This is disadvantageous from an economic standpoint. Thus, the weight ratio of hydrogen to the carbonaceous substance feed is preferably from 0.1/1 to 2.5/1 and more preferably from 0.12/1 to 2.0/1.

Carbonaceous substances which can be used in the process of the invention include not only coals such as anthracite, bituminous coal, sub-bituminous coal, brown coal, lignite, peat and grass peat, but also oil shale, tar sand, organic wastes, plants such as wood, and crude oil.

The process of the invention increases the cracking of the carbonaceous substances and accelerates the conversion of the carbonaceous substances into the gas and liquid products, greatly increasing the yields of the gasoline fraction and light oils.

The following examples are given to illustrate the invention in greater detail. It is to be noted, however, that the examples are given by way of illustration and are not to be construed to limit the scope of the invention.

The conversion of the carbonaceous substance into each reaction product is defined by the following formula:

$$\text{Conversion} = \frac{\text{Amount of carbon in each reaction product}}{\text{Amount of carbon in carbonaceous substance feed}} \times 100\ (\%)$$

EXAMPLE 1

Brown coal from Australia was finely pulverized and passed through a sieve of 100 mesh (JIS: Japanese Industrial Standard) to obtain finely ground coal. The elemental analytical values of the coal (anhydrous basis) are as shown in Table 1 below.

TABLE 1

| Element | Amount (% by weight) |
|---|---|
| C | 58.2 |
| H | 4.6 |
| O | 21.8 |
| N | 0.7 |
| S | 4.1 |
| Ash | 10.6 |

The finely ground coal (20 g) was added to 500 ml of distilled water in which 0.5 g of ferric chloride had previously been dissolved, and mixed and stirred for 30 minutes. The resulting mixture was heated at 75° C. under a reduced pressure of 20 mmHg to remove almost all of the water, and there was obtained the finely ground coal with ferric chloride deposited thereon. The amount of water was 5 parts by weight per 100 parts by weight of the finely ground coal with the ferric chloride deposited thereon.

The thus obtained finely ground coal (1 g) was introduced uniformly over a period of 1 minute into a reaction tube made of nickel-chromium-iron alloy (Incoloy 800: trademark) through which hydrogen gas was passed under the conditions of temperature of 730° C. and hydrogen pressure of 70 kg/cm$^2$ (gauge pressure). The residence time of the hydrogen gas passing through the heated reaction zone; i.e., the reaction time, was 7 seconds, and the weight ratio of the hydrogen fed for the reaction to the coal feed was 1.8/1. Of the reaction products from the reaction tube, char was separated in a char trap, a gasoline fraction and heavy oil were condensed and separated in an indirect cooler using a coolant of −68° C., and gases were reduced in pressure, collected in a sampling vessel, and analyzed.

On basis of the analytical results, the conversion of the coal into each product was calculated, and the results are shown in Table 2. In Table 2, ethylene is 5% of ethane, and the total of ethane and ethylene is called ethane.

EXAMPLES 2 TO 5

The procedure of Example 1 was repeated wherein the type of the metal compound to be added and the reaction temperature were changed as follows:

| Example | Type of Metal Compound | Reaction Temperature |
|---|---|---|
| 2 | Ferrous sulfate | 740° C. |
| 3 | Nickel sulfate | 745° C. |
| 4 | Cobalt phosphate | 760° C. |
| 5 | Palladium chloride | 775° C. |

In the case of cobalt phosphate (Example 4), however, it was finely ground to a grain size of 50 μm or less, and mixed with the finely ground coal in a ball mill for 3 hours to deposit on the coal.

In each example, the reaction products were analyzed in the same manner as in Example 1, and the results are shown in Table 2. In order to maintain the same reaction time, the flow rate of hydrogen was changed depending on the reaction temperature. (In the Examples and Comparative Examples which follow, the same procedure as above was employed.)

COMPARATIVE EXAMPLES 1 AND 2

The procedure of Example 1 was repeated wherein the ferric chloride was not added, and the coal was reacted at 795° C. (Comparative Example 1) or 740° C. (Comparative Example 2). In each example, the reaction products were analyzed in the same manner as in Example 1, and the results are shown in Table 2.

COMPARATIVE EXAMPLES 3 AND 4

The procedure of Example 1 was repeated wherein the type of the metal compound to be added and the reaction temperature were changed as follows:

| Comparative Example | Type of Metal Compound | Reaction Temperature |
|---|---|---|
| 3 | Cobalt sulfide | 730° C. |
| 4 | Molybdenum oxide | 725° C. |

In each example, the reaction products were analyzed in the same manner as in Example 1, and the results are shown in Table 2.

EXAMPLE 8

The same finely ground coal as used in Example 1 (10 g) was added to 500 ml of distilled water in which 0.7 g (anhydrous basis) of ferric nitrate had been previously dissolved, and the resulting mixture was stirred for 30 minutes. Then, 60 ml of distilled water with 0.6 g of potassium hydroxide dissolved therein was added to the mixture and stirred over one day and night. The precipitated iron hydroxide/coal mixture was filtered off with suction and fully washed with water until any potassium hydroxide was detected in the filtrate.

Then, the iron hydroxide/coal mixture was dried at 75° C. under a reduced pressure of 20 mmHg to adjust its water content to 5 parts by weight per 100 parts by weight of the mixture.

Using the thus-prepared iron hydroxide/coal mixture, the procedure of Example 1 was repeated wherein the reaction temperature was changed to 680° C. The reaction products were analyzed in the same manner as in Example 1.

On basis of the analytical results, the conversion of the coal into each reaction product (carbon basis) was calculated, and the results are shown in Table 3.

TABLE 2

| | Example No. | | | | | Comparative Example No. | | | |
|---|---|---|---|---|---|---|---|---|---|
| | 1 | 2 | 3 | 4 | 5 | 1 | 2 | 3 | 4 |
| Metal Compound | Iron chloride | Iron sulfate | Nickel sulfate | Cobalt phosphate | Palladium chloride | — | — | Cobalt Sulfide | Molybdenum oxide |
| Pressure (kg/cm$^2$) | 70 | 70 | 70 | 70 | 70 | 70 | 70 | 70 | 70 |
| Temperature (°C.) | 730 | 740 | 745 | 760 | 775 | 795 | 740 | 730 | 725 |
| Conversion (%)*1 | | | | | | | | | |
| Methane | 26.7 | 25.1 | 24.2 | 24.8 | 29.3 | 25.5 | 20.9 | 24.1 | 29.5 |
| Ethane | 5.8 | 5.7 | 5.8 | 4.8 | 4.4 | 3.6 | 5.5 | 5.6 | 4.2 |
| $CO + CO_2$ | 7.3 | 7.0 | 6.9 | 7.1 | 7.9 | 7.8 | 6.1 | 6.7 | 6.2 |
| Gasoline Fraction | 10.3 | 12.8 | 12.1 | 10.7 | 9.8 | 6.6 | 5.2 | 7.2 | 6.9 |
| Oil*2 | 14.0 | 12.2 | 11.8 | 11.4 | 8.1 | 5.0 | 6.3 | 9.2 | 5.2 |
| Char | 35.9 | 37.2 | 39.2 | 41.2 | 40.5 | 51.5 | 56.0 | 47.2 | 48.0 |

Note:
*1The conversion is a conversion from coal on the basis of carbon, expressed in percentage.
*2The light oil content of the oil is: from 60 to 70% by weight in Examples 1 to 5, and from 30 to 40% by weight in Comparative Examples 1 to 4.

EXAMPLES 6 AND 7

Figure 1:
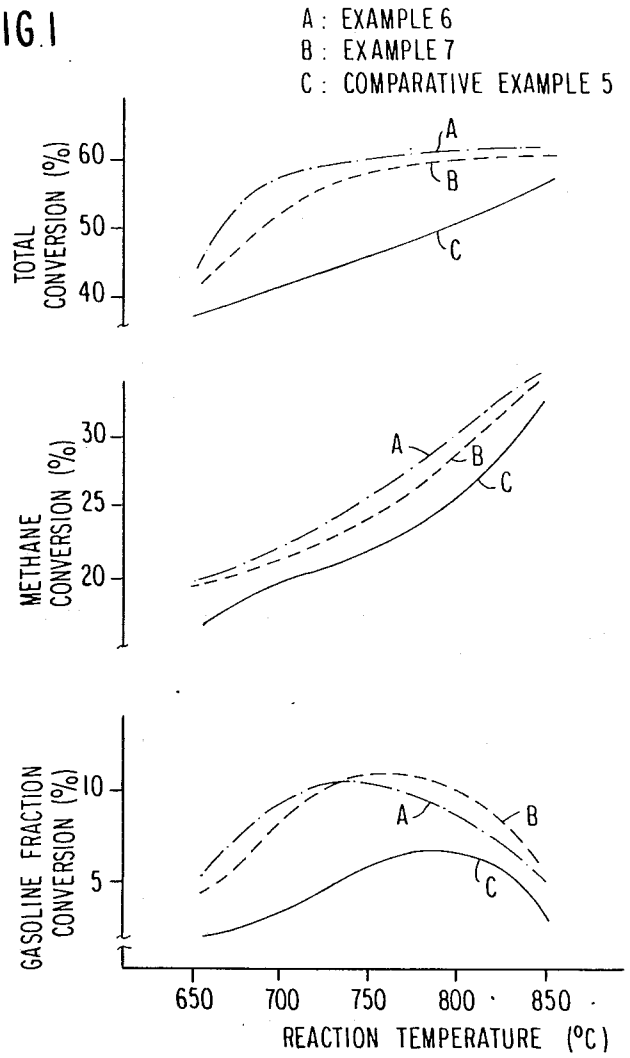
FIG. 1 shows graphs illustrating the relations between reaction temperature and total conversion, between reaction temperature and methane conversion, and between reaction temperature and gasoline fraction conversion in Examples 6 and 7, and Comparative Example 5.

The procedure of Example 1 was repeated wherein the type of the metal compound to be added and the reaction temperature were changed; i.e., ferric nitrate (Example 6) or nickel nitrate (Example 7) was used in place of ferric chloride, and in each case, the reaction was performed at the temperature of 650° C., 700° C., 750° C., 800° C., and 850° C. The reaction products were analyzed in the same manner as in Example 1. In FIG. 1, the conversions of the coal into the methane and gasoline fraction, and the total conversion are plotted against temperature, in which the line "A" indicates the results of Example 6 and the line "B" indicates the results of Example 7.

COMPARATIVE EXAMPLE 5

The procedure of Examples 6 and 7 was repeated wherein the ferric nitrate and nickel nitrate were not added, and only the finely ground coal was used to effect the cracking reaction. The reaction products were analyzed in the same manner as in Example 1. Also in FIG. 1, the conversions of the coal into the methane and gasoline fraction, and the total conversion are plotted against temperature, and indicated by the solid line "C".

EXAMPLE 9

The procedure of Example 8 was repeated wherein the type and amount of the metal compound to be used and the reaction temperature were changed; i.e., 0.5 g (anhydrous basis) of nickel sulfate, 0.5 g of potassium hydroxide, and a temperature of 660° C. were used in place of 0.7 g of ferric nitrate, 0.6 g of potassium hydroxide, and the temperature of 680° C. The reaction products were analyzed in the same manner as in Example 1, and the results are shown in Table 3.

EXAMPLES 10 TO 13

In these examples, iron oxide, cobalt hydroxide, cobalt carbonate (basic), and palladium oxide, all being commercially available high purity reagents, were used as metal compounds. Each metal compound (0.3 g) was finely ground to 50 μm or less, and placed in a ball mill together with 500 ml of distilled water. In the ball mill, 10 g of the same finely ground coal as used in Example 8 was placed, and the resulting mixture was stirred for 5 hours. At the end of the time, the mixture was filtered and dried to produce a metal compound-added coal. This metal compound-added coal was dried at 75° C. under a reduced pressure of 20 mmHg to adjust the water content to 5 parts by weight per 100 parts by weight thereof. The metal compound-added coal was reacted in the same manner as in Example 8 except that the reaction temperature was set at 700° C., 690° C., 670° C., and 680° C. The reaction products were analyzed in the same manner as in Example 1, and the results are shown in Table 3.

COMPARATIVE EXAMPLE 6

The procedure of Example 8 was repeated wherein the coal ground was dried without the addition of the metal compounds and cracked at a temperature of 670° C. The reaction products were analyzed in the same manner as in Example 1, and the results are shown in Table 3.

TABLE 3

| | Example No. | | | | | | Comparative |
|---|---|---|---|---|---|---|---|
| | 8 | 9 | 10 | 11 | 12 | 13 | Example 6 |
| Metal Compound | Iron hydroxide | Nickel hydroxide | Iron oxide | Cobalt hydroxide | Cobalt carbonate | Palladium oxide | — |
| Pressure (kg/cm$^2$) | 70 | 70 | 70 | 70 | 70 | 70 | 70 |
| Temperature (°C.) | 680 | 660 | 700 | 690 | 670 | 680 | 670 |
| Conversion*1 (%) | | | | | | | |
| Methane | 22.1 | 20.9 | 24.9 | 23.3 | 23.2 | 26.8 | 18.2 |
| Ethane | 12.4 | 13.6 | 9.7 | 11.2 | 9.3 | 7.3 | 5.1 |
| $CO + CO_2$ | 7.0 | 7.2 | 6.9 | 7.3 | 6.8 | 7.5 | 5.8 |
| Gasoline Fraction | 14.8 | 16.4 | 8.7 | 12.9 | 11.8 | 8.6 | 2.9 |
| Oil*2 | 15.0 | 13.9 | 13.2 | 11.4 | 13.7 | 9.0 | 7.6 |
| Char | 28.7 | 28.0 | 36.6 | 33.9 | 35.2 | 40.8 | 60.4 |

Note:
*1The conversion is a conversion from coal on the basis of carbon, expressed in percentage.
*2The light oil content is: from 60 to 70% by weight in Examples 8, 9, 11, and 12, 45% by weight in Example 10, and 33% by weight in Comparative Example 6.

EXAMPLES 14 AND 15

The procedure of Example 10 was repeated wherein the metal compouhnd to be added and the reaction temperature were changed; i.e., nickel oxide (Example 14) or cobalt hydroxide (Example 15) was used in place of iron oxide and in each case, the cracking reaction was performed at a temperature of from 600° to 830° C. The reaction products were analyzed in the same manner as in Example 1. On basis of the analytical results, the conversions of the coal into the ethane and gasoline fraction, and the total conversion was calculated, and plotted against temperature in FIG. 2. In FIG. 2, the line "D" indicates the results of Example 14, and the line "E" indicates the results of Example 15.

COMPARATIVE EXAMPLE 7

The procedure of Examples 14 and 15 was repeated wherein the metal compounds were not added; i.e. the coal was cracked in the absence of the metal compounds. The conversions of the coal into the ethane and gasoline fraction, and the total conversion were plotted against temperature, as shown in FIG. 2 by the solid line "F".

EXAMPLE 16

A reactor made of nickel-chromium-iron alloy (Incoloy 800: trademark) was divided into two zones, a first reaction zone and a second reaction zone. The first reaction zone was connected to a coal-supplying unit at one end thereof. A coal feed was introduced into the first reaction zone, and thermally cracked at a high rate. The thermal cracking reaction was performed so that the residence time of a cracked product/hydrogen (introduced for the reaction) stream was less than 1 second. In the second reaction zone, the residence time of the cracked product/hydrogen stream was set at 6 seconds. The first and second reaction zones were connected to each other by means of a pipe of small diameter, which was designed so that the time taken for the cracked product/hydrogen stream to pass therethrough was 50 milliseconds. The first and second reaction zones were provided with different electric heaters for heating.

The temperatures of the first and second reaction zones were set at 725° C. and 800° C., respectively, and the pressure in the reactor was maintained at 70 kg/cm$^2$. Moreover, the hydrogen gas for the reaction was passed through the reactor so that the above-described residence times were attained.

A brown coal powder from Australia on which ferric chloride had been deposited in the same manner as in Example 1 was introduced into the reactor at a rate of 1 g per minute, and reacted. The weight ratio of the hydrogen (introduced for the reaction) to the coal was 1.6/1. Reaction products were cooled and analyzed in the same manner as in Example 1.

On basis of the analytical results, the conversion of the coal into each product (carbon basis) was determined, and the results are shown in Table 4.

EXAMPLES 17 TO 19

The procedure of Example 16 was repeated wherein the type of the metal compound and the temperature in the first reaction zone were changed as follows:

| Example | Type of Additive | Temperature |
|---|---|---|
| 17 | Ferrous sulfate | 740° C. |
| 18 | Nickel sulfate | 745° C. |
| 19 | Cobalt nitrate | 755° C. |

The results are shown in Table 4.

COMPARATIVE EXAMPLE 8

The procedure of Example 16 was repeated wherein the metal compound was not added, and the brown coal powder from Australia was reacted at the first reaction temperature of 740° C. The results are shown in Table 4.

TABLE 4

| | Example No. | | | | Comparative |
|---|---|---|---|---|---|
| | 16 | 17 | 18 | 19 | Example 8 |
| Metal Compound | Iron chloride | Iron sulfate | Nickel sulfate | Cobalt nitrate | — |

TABLE 4-continued

| | Example No. | | | | Comparative Example 8 |
|---|---|---|---|---|---|
| | 16 | 17 | 18 | 19 | |
| Pressure (kg/cm$^2$) | 70 | 70 | 70 | 70 | 70 |
| Temperature (°C.) | | | | | |
| 1st Reaction Zone | 725 | 740 | 745 | 755 | 740 |
| 2nd Reaction Zone | 800 | 800 | 800 | 800 | 800 |
| Conversion*1 (%) | | | | | |
| Methane | 32.8 | 31.6 | 30.8 | 29.3 | 24.2 |
| Ethane | 5.0 | 4.9 | 5.2 | 4.0 | 4.7 |
| CO + $CO_2$ | 7.4 | 7.2 | 7.4 | 7.6 | 6.6 |
| Gasoline Fraction | 13.6 | 15.0 | 15.2 | 12.3 | 6.1 |
| Oil*2 | 6.7 | 5.9 | 7.4 | 6.9 | 5.4 |
| Char | 34.5 | 35.4 | 36.7 | 39.9 | 53.0 |

Note:
*1The conversion is a conversion from coal on the basis of carbon, expressed in percentage.
*2The light oil content is: from 60 to 70% by weight in Examples 16 to 19, and 37% by weight in Comparative Example 8.

EXAMPLE 20

The same reactor as used in Example 16 was used, and the temperatures of the first and second reaction zones were set to 670° C. and 800° C., respectively. A brown coal powder from Australia on which iron hydroxide had been deposited in the same manner as in Example 8 was introduced into the reactor at a rate of 1 gram per minute and reacted.

The results are shown in Table 5.

EXAMPLES 21 TO 23

A thermal cracking reaction was performed under the same conditions as in Example 20 except that the temperature of the first reaction zone and the metal compound were changed.

The results are shown in Table 5.

COMPARATIVE EXAMPLE 9

The procedure of Example 20 was repeated wherein the brown coal powder from Australia ground and dried without the addition of the metal compound was used, and the temperature of the first reaction zone was set at 670° C.

TABLE 5

| | Example No. | | | | Comparative Example 9 |
|---|---|---|---|---|---|
| | 20 | 21 | 22 | 23 | |
| Metal Compound | Iron hydroxide | Nickel hydroxide | Cobalt hydroxide | Nickel carbonate | — |
| Pressure (kg/cm$^2$) | 70 | 70 | 70 | 70 | 70 |
| Temperature (°C.) | | | | | |
| 1st Reaction Zone | 670 | 650 | 690 | 660 | 670 |
| 2nd Reaction Zone | 800 | 800 | 800 | 800 | 800 |
| Conversion*1 (%) | | | | | |
| Methane | 28.3 | 25.9 | 28.7 | 27.1 | 23.1 |
| Ethane | 11.8 | 12.7 | 10.9 | 11.3 | 4.5 |
| CO + $CO_2$ | 7.3 | 7.4 | 7.6 | 7.4 | 6.3 |
| Gasoline Fraction | 17.1 | 18.8 | 16.9 | 17.3 | 5.8 |
| Oil*2 | 7.0 | 7.6 | 6.3 | 6.9 | 6.1 |
| Char | 28.5 | 27.6 | 30.6 | 30.0 | 54.2 |

Note:
*1The conversion is a conversion from coal on the basis of carbon, expressed in percentage.
*2The light oil content is: from 60 to 70% by weight in Examples 20 to 23, and 38% by weight in Comparative Example 9.

It is seen from the results shown in Table 2 and 3 and FIG. 1 and 2 that carbonaceous substances can be converted into gasoline fraction and light oils in large amounts in thermal cracking of carbonaceous substances when performed in the presence of the metal compounds of the present invention, and also seen from the results shown in Tables 4 and 5 that the gasoline fraction conversion is further increased by cracking thermally cracked carbonaceous substance at an increased temperature in the later stage of the thermal cracking.

While the invention has been described in detail and with reference to specific embodiment thereof, it will be apparent to one skilled in the art that various changes and modifications can be made therein without departing from the spirit and scope thereof.

What is claimed is:

1. A process for thermally cracking a carbonaceous substance comprising the steps of:

providing a reaction vessel containing an atmosphere comprised of hydrogen gas at a pressure of from 35 to 250 kg/cm$^2$ (gauge pressure);

providing a carbonaceous substance not in the form of a slurry within the reaction vessel;

providing a metal compound within the reaction vessel in an amount of 0.0001 to 0.2 parts by weight per parts by weight of the carbonaceous substance wherein the metal compound is selected from the group consisting of halides, sulfates, nitrates, phosphates, carbonates, hydroxides and oxides of the metal elements selected from the group consisting of Fe, Co and Ni;

rapidly heating the carbonaceous substances in the reaction vessel to a temperature of from 500° to 950° C.; and allowing the cracking reaction to proceed between the hydrogen gas and the carbonaceous substance.

2. A process for thermally cracking a carbonaceous substances as claimed in claim 1, wherein the metal compound is added in an amount of 0.001 to 0.1 part by weight per part by weight of the carbonaceous substance.

3. A process for thermally cracking a carbonaceous substance as claimed in claim 1, wherein the metal compound is a compound selected from the group consisting of halides, sulfates, nitrates, phosphates, carbonates and hydroxides.

4. A process for thermally cracking a carbonaceous substance as claimed in claim 1, wherein the metal compound is a compound selected from the group consisting of sulfates, nitrates, carbonates and hydroxides.

5. A process for thermally cracking a carbonaceous substance as claimed in claim 1, wherein the carbonaceous substance is heated in the reaction vessel for a period of time of from 0.02 to 60 seconds.

6. A process for thermally cracking a carbonaceous substance as claimed in claim 5, wherein the carbonaceous substance is heated for a period of time of from 2 to 30 seconds.

7. A process for thermally cracking a carbonaceous substance as claimed in claim 1, wherein the carbonaceous substance is heated at a rate of 100° C./second or more.

8. A process for thermally cracking a carbonaceous substance as claimed in claim 7, wherein the carbonaceous substance is heated at a rate of 1000° C./second or more.

9. A process for thermally cracking a carbonaceous substance as claimed in claim 1, wherein the hydrogen gas is present in the reaction vessel at a pressure of from 50 to 200 kg/cm$^2$.

10. A process for thermally cracking a carbonaceous substance as claimed in claim 1, wherein the weight ratio of the hydrogen to the carbonaceous substance is within the range of 0.1/1 to 2.5/1.

11. A process for thermally cracking a carbonaceous substance as claimed in claim 10, wherein the weight ratio of the hydrogen to the carbonaceous substance is within the range of 0.12/1 to 2.0/1.

12. A process for thermally cracking a carbonaceous substance as claimed in claim 1, wherein the carbonaceous substance is rapidly heated in the reaction vessel to a temperature of from 600° to 850° C.

13. A process for thermally cracking a carbonaceous substance comprising the steps of:

providing a reaction vessel containing an atmosphere comprised of hydrogen gas at a pressure of from 35 to 250 kg/cm$^2$ (gauge pressure);

providing a carbonaceous substance not in the form of a slurry within the reaction vessel;

providing a metal compound within the reaction vessel in an amount of 0.0001 to 0.2 parts by weight per parts by weight of the carbonaceous substance wherein the metal compound is selected from the group consisting of halides, sulfates, nitrates, phosphates, carbonates, hydroxides and oxides of the metal elements selected from the group consisting of Fe, Co and Ni;

rapidly heating the carbonaceous substances in the reaction vessel to a temperature of from 500° to 900° C. in order to form a thermally cracked carbonaceous substance; and immediately thereafter and without any intermediate step cracking the thermally cracked carbonaceous substance at a temperature above the temperature at which the thermally cracked carbonaceous substance was formed and within the range of from 600° to 950° C.

14. A process for thermally cracking a carbonaceous substance as claimed in claim 13, wherein the metal compound is present in the reaction vessel in an amount within the range of 0.001 to 0.1 part by weight per part by weight of the carbonaceous substance.

15. A process for thermally cracking a carbonaceous substance as claimed in claim 13, wherein the metal compound is a compound selected from the group consisting of halides, sulfates, nitrates, phosphates, carbonates and hydroxides.

16. A process for thermally cracking a carbonaceous substance as claimed in claim 13, wherein the metal compound is selected from the group consisting of sulfate, nitrates, carbonates and hydroxides.

17. A process for thermally cracking a carbonaceous substance as claimed in claim 13, wherein the carbonaceous substance is rapidly heated in the reaction vessel to a temperature of from 600° to 850° C.

18. A process for thermally cracking a carbonaceous substance as claimed in claim 13, wherein the second cracking temperature is from 10° to 150° C. above the first cracking temperature.

19. A process for thermally cracking a carbonaceous substance as claimed in claim 13, wherein the thermally cracked carbonaceous substance is reacted in the second cracking step for a period from 1 to 60 seconds.

20. A process for thermally cracking a carbonaceous substance as claimed in claim 19, wherein the reaction time is from 2 to 30 seconds.

21. A process for thermally cracking a carbonaceous substance as claimed in caim 13, wherein said cracking the thermally cracked carbonaceous substance at a temperature above the temperature at which the thermally cracked carbonaceous substance was formed is a vapor phase hydrogenation.

* * * * *